US005215285A

United States Patent [19]

Lewis

[11] Patent Number: 5,215,285

[45] Date of Patent: Jun. 1, 1993

[54] DISPLAY CARD HOLDER

[76] Inventor: Richard G. Lewis, Box 75, Millarville, Alberta, Canada, T0L 1K0

[21] Appl. No.: 806,283

[22] Filed: Dec. 13, 1991

[51] Int. Cl.[5] ..... G09F 19/00

[52] U.S. Cl. ..... 248/457; 248/473; 40/546; 40/606

[58] Field of Search ..... 248/473, 441.1, 450, 248/454, 457; 40/124, 152.1, 546, 606

[56] References Cited

U.S. PATENT DOCUMENTS

| | | | |
|---|---|---|---|
| 715,532 | 12/1902 | Anderson . | |
| 2,268,077 | 12/1941 | Leonard et al. | 248/33 |
| 3,965,600 | 6/1976 | Paskerian | 40/152.1 |
| 4,473,963 | 10/1984 | Hardy et al. | 40/10 R |
| 4,791,745 | 12/1988 | Pohn | 40/546 |
| 5,031,870 | 7/1991 | Higgins | 248/473 |

OTHER PUBLICATIONS

Display Card Mounting Device, Eddy Associates, Spring 1991.

*Primary Examiner*—Alvin C. Chin-Shue
*Attorney, Agent, or Firm*—Sughrue, Mion, Zinn, Macpeak & Seas

[57] ABSTRACT

A display card holder for releasably mounting a display card, sign, poster, etc. The display card holder serves as a permanent, tamper proof, message holder for inexpensive point of purchase material in a high risk exposure retail environment. The display card holder includes a stand having adhesive thereon for fixing the holder in a conspicuous location, e.g., on top of a cash register or counter top, so that the display card is visible to consumers. The holder further includes a substantially hollow, elongated housing having a body portion and first and second end walls. The housing is secured to the stand by fastening means, so as to allow for angular adjustment of the housing and display card or sign with respect to the stand. The housing includes a longitudinal slot for receiving the display card or sign and which extends along an upper surface of the body portion. First and second end pieces respectively pass through corresponding openings in the first and second end walls and are slidably supported on guide rails disposed within the housing. Each end piece comprises a pinching mechanism including a bifurcated member having a gap for receiving and pinching the lower edge of the display card. Each end piece further includes a locking member for engaging a corresponding notch in the display card.

19 Claims, 4 Drawing Sheets

DISPLAY CARD HOLDER

BACKGROUND OF THE INVENTION

My invention provides a display card holder or mounting apparatus for releasably mounting a display card, advertisement, sign, poster, etc. The mounting apparatus serves as a permanent, tamper proof, message holder for inexpensive point of purchase material in a high risk exposure retail environment. In particular, the mounting apparatus is positioned at a location such that the display card, etc., is readily visible to consumers, e.g., on top of a cash register or counter top.

In general, it is known to support a display card or sign in commercial establishments by means of a releasable mounting device. Such display cards normally include indicia thereon for advertising or promoting a particular product. For example, U.S. Pat. No. 5,031,870 (Higgins) discloses a display card mounting device for releasably supporting cards, o signs and the like. The device includes a card engaging member movable between a card retaining position and a card releasing position, and manually operated tabs for operating the card engaging member.

U.S. Pat. No. 4,473,963 (Hardy et al) discloses s a sign support for releasably attaching a sign to a display stand.

U.S. Pat. No. 2,268,077 (Leonard et al) discloses a holder for use on restaurant counters and tables for holding menus in an upright position, and which is also designed for holding salt, pepper and sugar shakers. The holder includes a one piece tray having a trough for receiving menus. A clamping plate is provided in the trough and cooperates with a rear side of the trough to clamp the lower edges of the menus.

U.S. Pat. No. 715,532 (Anderson) discloses a card holder for receiving menu-cards, photographs, and the like. The card holder includes a body having a transverse slot therein. A spring is secured to the body and extends down into the slot.

SUMMARY OF THE INVENTION

It is an object of the present invention to provide a display card holder or mounting apparatus for releasably mounting a display card, advertisement, sign, poster, etc. The mounting apparatus provides a simple and inexpensive means for supporting a card or sign used in advertising or promoting a product and the like, the holder being aesthetically pleasing to the eye.

In particular, the holder includes a support means in the form of a stand, and a substantially hollow, elongated housing having a body portion and first and second end walls. The housing is connected to the stand at the first and second end walls by fastening means, so as to allow for angular adjustment of the housing and display card or sign with respect to the stand. The housing includes a longitudinal slot for receiving the display card or sign and which extends along an upper surface of said body portion between said first and second end walls. Each of the first and second end walls of the housing includes an opening or window. First and second end pieces respectively pass through the corresponding openings in the first and second end walls and are slidably supported on guide means disposed within the housing. Each end piece comprises a pinching mechanism including a bifurcated member having a gap for receiving and pinching the lower edge of the display card. Each end piece further includes a locking member for engaging a corresponding notch in the display card.

BRIEF DESCRIPTION OF THE DRAWINGS

Other features and advantages of the present invention will be apparent from the following description taken in connection with the accompanying drawings wherein.

DETAILED DESCRIPTION OF THE PREFERRED EMBODIMENTS

Figure 1:
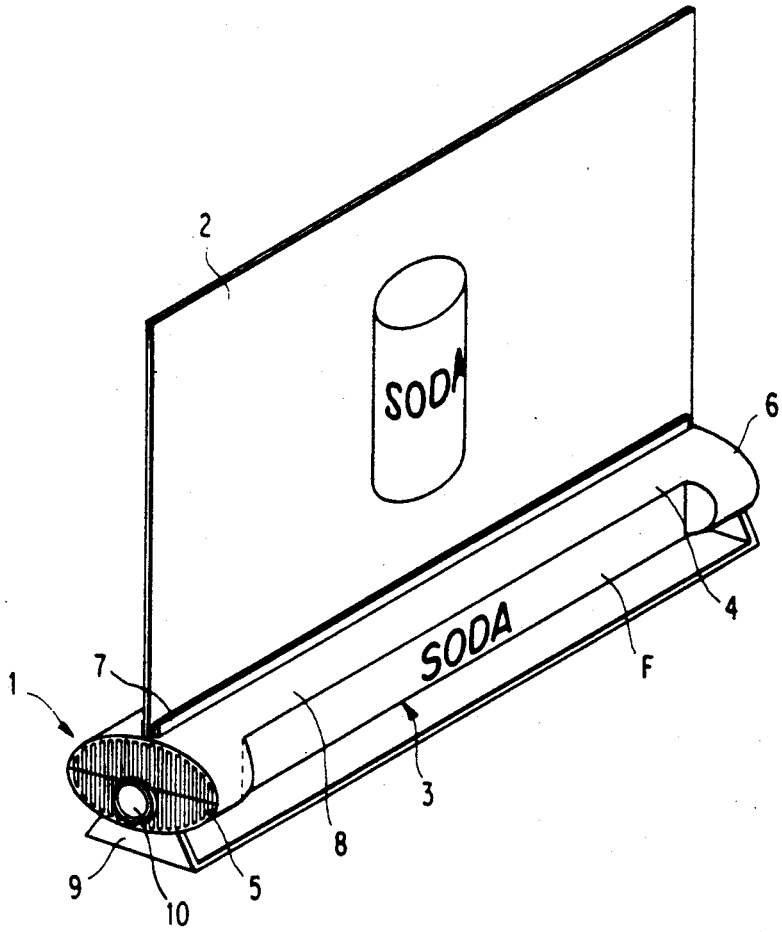
FIG. 1 is a perspective view of the display card holder according to the present invention.

The invention will now be described with reference to the drawings. As shown in FIG. 1, the display card holder or mounting apparatus is generally denoted by the reference numeral 1. As will be described in more detail below, the holder is designed to releasably support a display card or sign 2. The display card 2 will normally include indicia and/or graphics such as indicated by the soft drink can labeled "SODA". The indicia may be in the form of an advertisement for a particular product. Likewise, a picture, logo, etc., could be displayed on the card 2.

The holder 1 includes a substantially hollow, elongated housing 3. The housing 3 is preferably elliptical or oval in cross section, although not limited to such a shape, and includes a body portion 4 and first and second end walls 5 and 6, respectively, with only the first end wall 5 being visible in FIG. 1. The housing 3 includes a longitudinal slot 7 for receiving the lower edge of the display card 2 as will be described in more detail below. The slot 7 extends along an upper surface 8 of the body portion 4 between the first and second end walls 5 and 6.

The housing 3 is adjustably mounted to a support means in the form of a stand 9 (see FIG. 2) at the first and second end walls 5 and 6, respectively, by fastening means 10, 10'. The fastening means may take the form of a plastic, brass, or aluminum end screw or thumbscrew for aesthetic reasons. The stand 9 comprises a platform 11 and a pair of vertical arms 12, 12' having respective openings 13, 13' therethrough for receiving the shank portions 14, 14' of the corresponding fastening means 10, 10' (see FIG. 2). Double-sided adhesive tape (not shown) is disposed on the bottom of the platform 11 of the stand 9. Accordingly, once a protective covering is peeled off the tape, the stand 9, along with the holder 1, is then adhered to a cash register, counter top or the like.

The openings 13 and 13' each have a brass, aluminum or plastic screw nut 16 and 16', respectively, inserted therein. Each nut 16, 16' is internally threaded for threadingly engaging the fastening means 10, 10'. Each nut 16, 16' is also knurled on the outer surface for gripping stand 9 when press-fitted into openings 13, 13'. O-rings 17 and 17' are provided as friction devices between the arms 12 and 12', respectively, and the housing 3.

Of course the support means could alternatively be formed by a flat surface on the bottom of the housing 3 instead of utilizing a separate stand 9.

As shown in FIG. 1, the body portion 4 of the holder housing 3 may advantageously have a flat portion F for forming indicia, pictures, etc., thereon by any suitable process to further promote or advertise a product, etc. For example, indicia may be formed on the flat portion by silk-screening, tab printing or hot foil stamping.

The specific structure of the housing 3 of the display card holder 1 will now be described with reference to FIGS. 2–5B.

Figure 2:
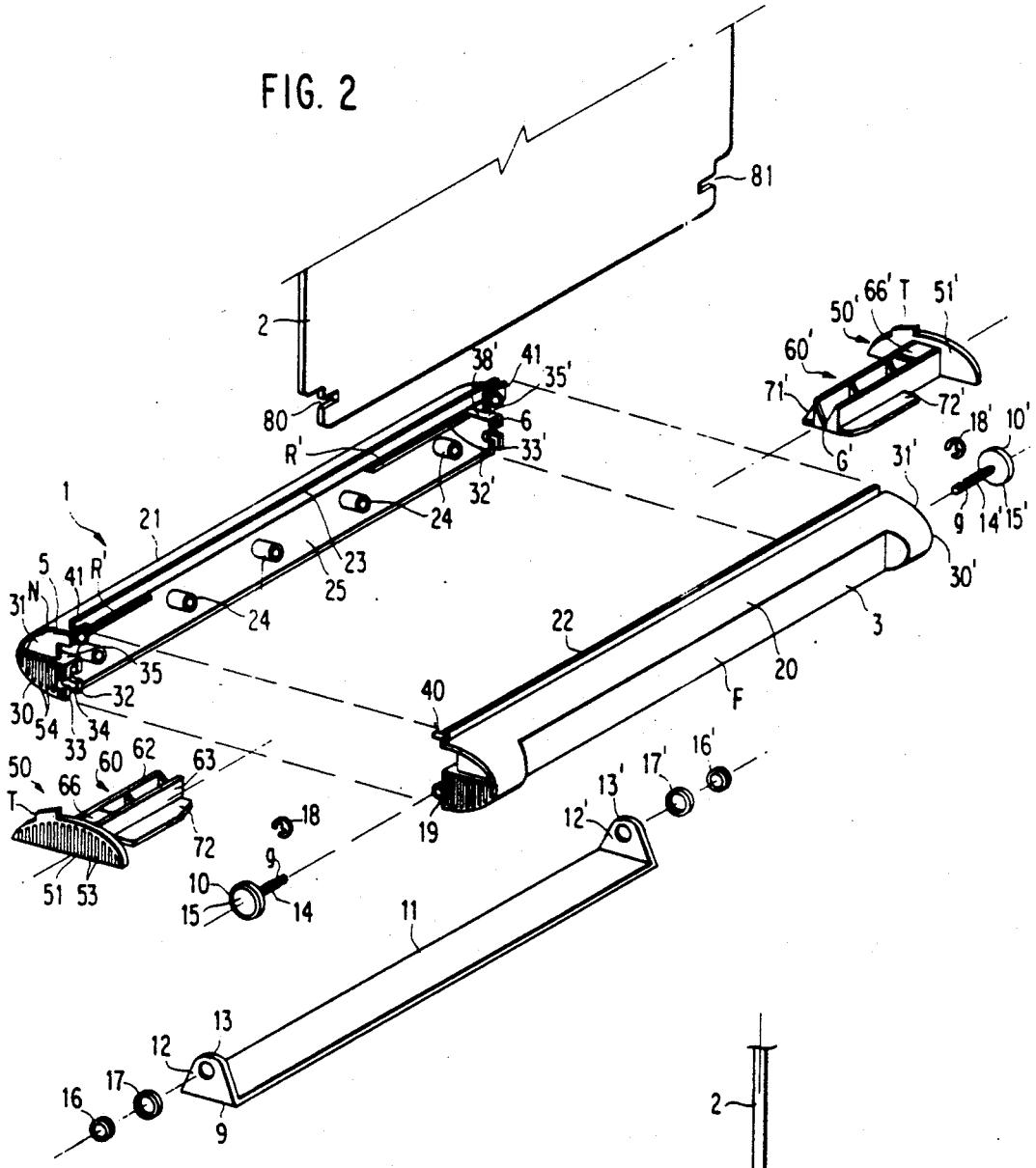
FIG. 2 is an exploded view of the display card holder including a fragmentary view of the display card or sign.

As shown in FIG. 2, the housing 3 comprises a front portion or cabinet 20 and a rear portion or cabinet 21. The front cabinet 20 is formed with the flat portion F which is an indent in the elliptical body portion 4. The housing 3 is divided along the minor axis of the ellipse when viewed in cross section (see FIG. 3), such that when the front and rear portions 20 and 21 are joined together, the elliptical shaped housing is formed. At the upper edge of each of the front and rear portions 20 and 21, an upright flange or lip 22, 23 extends a short distance above the body portion 4. When the front and rear portions 20 and 21 are joined together, the lips 22 and 23 together form the longitudinal slot 7 therebetween for receiving the lower edge of the display card 2.

Figure 3:
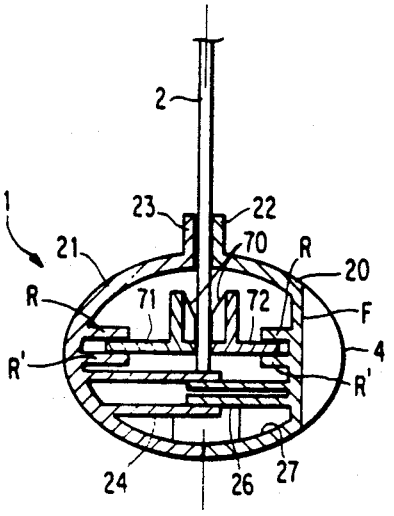
FIG. 3 is a cross sectional view through one end portion of the holder housing.

At a location generally below the major axis of the elliptical housing 3 when viewed in cross section (see FIG. 3), a plurality of hollow bosses 24 (for example, five) project inwardly from an inner surface 25 of the rear portion 21. The bosses 24 may have a circular cross section but are not limited to this shape. The bosses 24 are equally spaced longitudinally along the inner surface 25 of the rear portion 21. Further, a plurality of corresponding hollow bosses 26, one of which is shown in FIG. 3, project inwardly from a flat inner surface 27 of the front portion 20. The bosses 26 are equal in number to bosses 24 and have a complementary shape thereto. However, the bosses 26 are smaller than the bosses 24 such that they may slidably fit into the bosses 24 in a snug manner by means of a friction fit when the front and rear portions 20 and 21 are joined together. In this way, the bosses provide a means for tightly securing the front and rear portions 20 and 2 together.

The end walls 5 and 6, in addition to being divided vertically along the minor axis of the ellipse so that the front and rear cabinets 20 and 21 are separable thereat, are further sectioned into a lower section 30 (left end in FIG. 2), 30' (right end in FIG. 2) and an upper section 31, 31'. The partition line between the upper and lower sections 30, 30' and 31, 31' is substantially along the major axis of the ellipse. As shown in FIG. 2, the lower section 30, 30' comprises an inner wall 32, 32' and an outer wall 33, 33' which are spaced apart so as to form a channel 34, 34' therebetween. The walls 32, 32' and 33, 33' are joined together by a horizontal connecting wall 35, 35'. Each channel 34, 34' opens outwardly on the underside of the elliptical housing 3 and is designed to receive the corresponding arm 12, 12' of the stand 9.

The lower sections 30, 30' also include through holes for allowing the thumbscrews 10, 10' to pass therethrough. The inner wall 32, 32' and outer wall 33, 33' are formed with through holes 36, 36' and 37, 37', respectively, for allowing passage of the shank portion 14, 14' of the corresponding thumbscrew 10, 10'. Accordingly, when the screw nuts 16, 16' of the arms 12, 12' of the stand 9 are aligned with the through holes 36, 36' and 37, 37' by inserting the arms 12, 12' into the corresponding channels 34, 34', the thumbscrews 10, 10' are threaded therethrough. The front cabinet 20 includes a molded plastic shoulder 19 (the right side shoulder is not visible) disposed in the front half of through holes 37, 37' of each outer wall 33, 33'. The shank portions 14, 14' of the thumbscrews pass through the respective shoulders 19.

The shank portion 14, 14' of each thumbscrew 10, 10' includes a groove g at the free end thereof for receiving an E-clip 18, 18'. The E-clip 18, 18' simply prevents the thumbscrew 10, 10' from falling out of the holder i when loosened.

The upper section 31 of end wall 5 is slightly recessed such that the edge of the housing 3 overhangs beyond the upper section 31 (see FIG. 5B) for reasons discussed later on. The upper section 31 also includes an opening or window 38 for allowing an end piece 50 (described later) to pass therethrough. The window 38 is partly formed in the end wall portion of the rear cabinet 21 and partly formed in the end wall portion of the front cabinet 20. Accordingly, when the front and rear cabinets are joined together, a single window 38 is formed. The upper section 31' on the opposite end wall 6 likewise is recessed and includes a window 38' for allowing end piece 50' to pass therethrough.

Figure 5A:
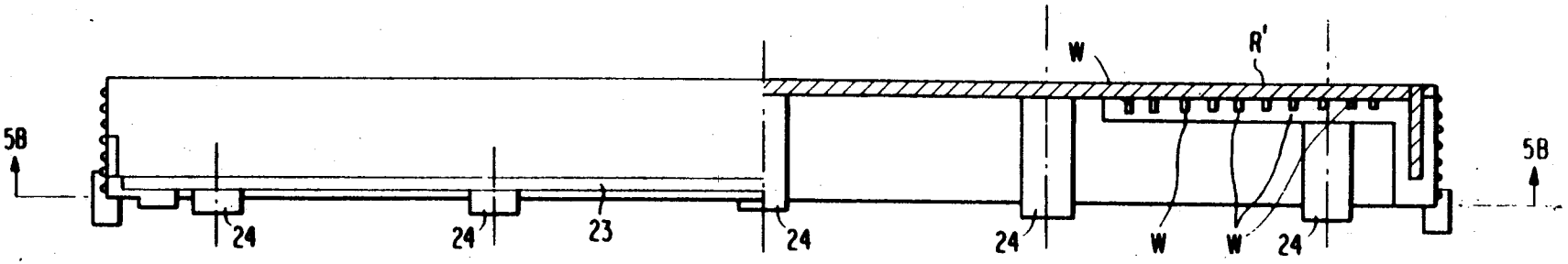
FIG. 5A is a fragmentary top view of the rear portion or cabinet of the holder.
Figure 5B:
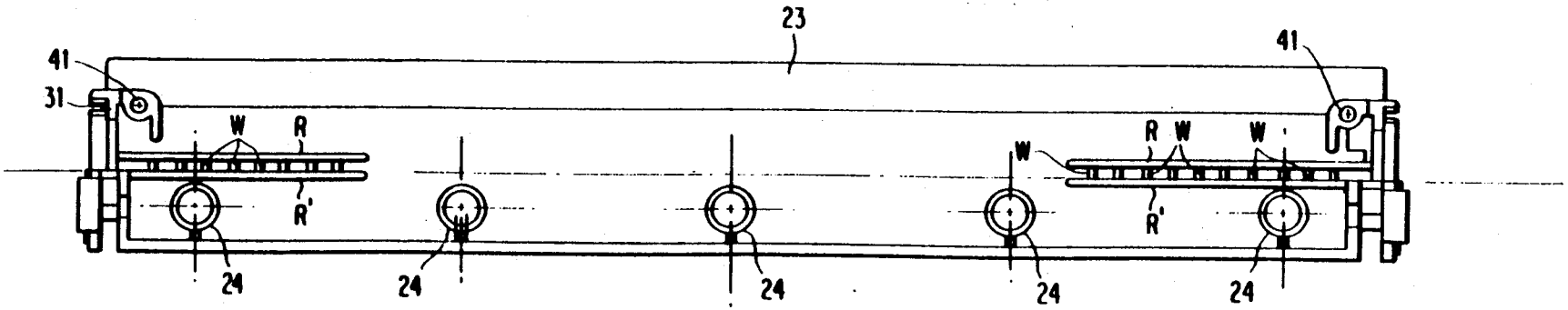
FIG. 5B is a side view of the rear portion or cabinet of the holder in the direction 5B—5B in FIG. 5A.

Referring to FIGS. 3, 5A and 5B, each of the front and rear cabinets 20 and 21 includes guide means at opposite ends thereof in the form of upper and lower rails R and R'. The rails R and R' extend inwardly from the inner surface of the respective cabinet 20 and 21. The rails R and R' are located above the bosses 24 and 26, with each of the lower rails R' being flush with the corresponding connecting wall 35, 35'. Accordingly, when the front and rear cabinets 20 and 21 are joined together, there are opposing pairs of rails R, R' disposed at opposite ends of the elliptical housing 3 (see especially FIGS. 3 and 5B). Note, only the rear cabinet 21 is shown in FIGS. 5A and 5B for the sake of brevity. Of course, front cabinet 20 is substantially similar in structure, although the front cabinet includes the flat portion F for forming indicia thereon.

In addition to the bosses 24 and 26, the front cabinet 20 may include solid projections or pins 40 (only one of which is visible in FIG. 2) at opposite ends in the vicinity of the lip 22. The pins 40 are inserted into corresponding blind bores 41 (see FIGS. 2 and 5B) formed at opposite ends of the rear cabinet 21 near the lip 23. The pins 40 and blind bores 41 provide additional support when the front and rear cabinets 20 and 21 are joined together by friction fit.

The specific structure of the movable end pieces 50 and 50' will now be described with reference to FIGS. 2, 3, 4A, 4B and 4C. Since the end piece 50, which is disposed in the left end of the housing 3, is identical in structure to the end piece 50', which is disposed in the right end of the housing 3, only the end piece 50 is shown and described.

Figure 4B:
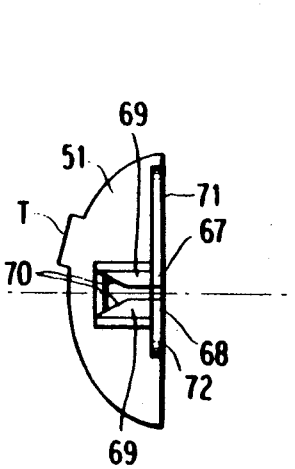
FIG. 4B is an end view of the left side end piece in the direction 4B—4B in FIG. 4A.
Figure 4A:
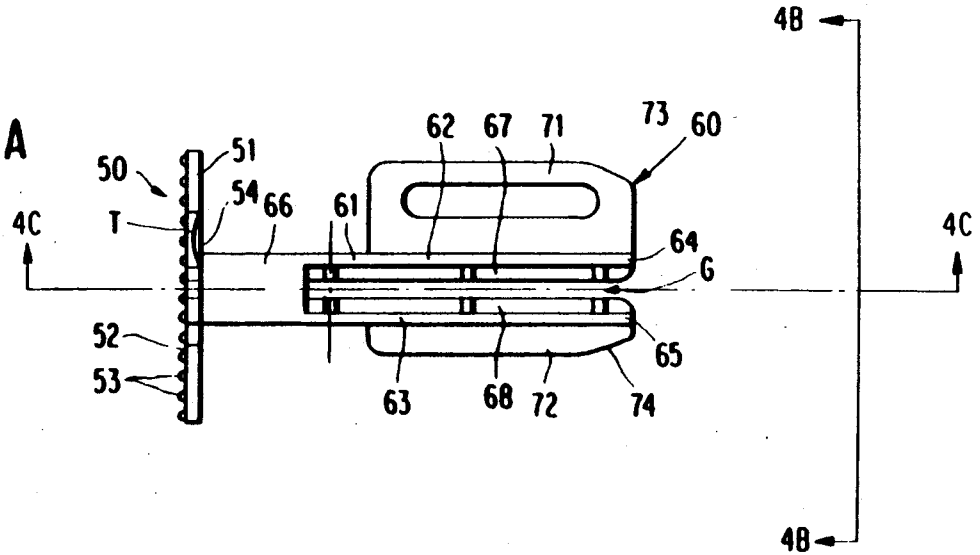
FIG. 4A is a top view of the left side end piece of the holder.
Figure 4C:
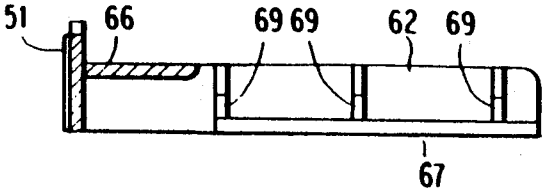
FIG. 4C is a cross sectional view through the left side end piece along the line 4C—4C in FIG. 4A.

As best shown in FIGS. 2 and 4A, the end piece 50 includes an end plate 51 which is shaped so as to correspond to the upper half of the ellipse (i.e., upper section 31) when viewing the housing 3 from the left end. The outer surface of the end plate 51 is formed with a ribbed surface 52. The ribs 53 are arranged vertically and are designed to align with corresponding ribs 54 formed in the lower section 30 of end wall 5. In this manner, when the end plate 51 is pressed against the upper section 31 of end wall 5, with the outer surface of the lower section 30. As a result, the opposite ends of the housing 3 are ellipses with ribbed surfaces.

As best shown in FIG. 4B, the end plate 51 includes a tab T. The tab T fits into a corresponding notch N formed in the edge of the housing 3 which overhangs beyond the upper section 31, when the end plate 51 is pressed against the upper section 31. The inner surface of the tab T may be dished out as at 54 (see FIG. 4A), so as to allow a user to insert a fingernail therein to pull out the end piece 50.

Means 60 for pinching the lower edge of the display card 2 extends inwardly from an inner face of the end plate 51. The pinching means 60 comprises a bifurcated member 61 having two parallel, spaced-apart vertical walls 62 and 63 which are each fixed at one end to the inner face of the end plate 51 and which have free ends 64 and 65 extending into the hollow housing 3.

At the location where the two vertical walls 62 and 63 are fixed to the end plate 51, a horizontal wall 66, which is fixed to the end plate 51, extends between an upper portion of the two vertical walls 62 and 63 and connects them together. The horizontal wall 66 extends a predetermined distance toward the free ends 64, 65 of the vertical walls 62 and 63, which distance is preferably less than a third of the distance in which the vertical walls 62 and 63 extend away from the end plate 51, although not limited to this ratio. The horizontal wall 66 serves as a locking member for locking the display card into the holder 1 as will be discussed in more detail later on.

At the base of the vertical walls 62 and 63, respective rims 67 and 68 extend a short distance inwardly. A gap G, which corresponds approximately to the width of a display card, is formed between the rims 67 and 68.

A plurality of vertical ribs 69 are positioned along the inner surfaces of the two vertical walls 62 and 63. The ribs 69 are arranged in opposing fashion such that pairs of opposing ribs are equally spaced along the inner surfaces of the vertical walls 62 and 63. The ribs 69 extend upwardly with respect to the corresponding rim 67, 68 and are perpendicular to the two vertical walls 62 and 63. As best seen in FIGS. 2, 3 and 4B, the upper edges of the ribs 69 are chamfered as at 70. This simply helps to guide the lower edge of the display card 2 when inserting the card into the holder 1.

On the outer surfaces of the two vertical walls 62 and 63, ledges 71 and 72 extend perpendicularly from the base of the corresponding vertical wall. The ledge 71 is aligned with the rim 67 and the ledge 72 is aligned with the rim 68 (see FIG. 4B). The ledges 71 and 72 are slidably fitted between the rails R and R' in rear cabinet 21 and the rails R and R' in the front cabinet 20 (see especially FIG. 3). As shown in FIGS. 4A and 4B, the ledge 71 extends out further from the vertical wall 62 than the ledge 72 extends from the vertical wall 63. This simply compensates for the smaller space within the front cabinet 20 due to the presence of the flat wall portion F.

As shown in FIGS. 5A and 5B, a plurality of webs W extend vertically between each of the upper and lower rails R and R'. The webs W are equally spaced apart along the rails (e.g., 1–2 mm) and project inwardly a preset distance which is less than the distance that the rails R and R' project into the housing 3. As shown in FIG. 5A, the webs W project inwardly at an increasingly greater distance the farther away from the end wall 5 the webs W are located. Thus, a converging path is formed by the webs W. Accordingly, when the end plate 51 and pinching means 60 are moved inwardly by manual depression, the ledges 71 and 72 slide between the corresponding rails R and R'. As the end piece 50 reaches its final, inserted position within the housing 3, the webs W squeeze the vertical walls 62 and 63 together by engaging the ledges 71 and 72. The outer edges of the ledges 71 and 72 are bevelled as at 73 and 74 to facilitate sliding along the webs W. Accordingly, the display card 2 is pinched in the gap G between the two vertical walls.

The display card 2 may be provided with notches 80 and 81. The notch 80 is designed to be engaged by the horizontal wall 66 when the end piece 50 is fully inserted into the housing 3. In this manner, the wall 66 serves as a locking member to lock the display card in place in addition to the pinching action of the vertical walls 62 and 63 with respect to the end piece 50. Likewise, the end piece 50' includes a horizontal wall 66' for engaging the notch 81 of the display card 2.

The operation of the holder 1 will now be briefly described below.

Before inserting a display card 2 into the holder 1, the left and right end pieces 50 and 50' are slightly withdrawn from the housing 3 through the corresponding windows 38 and 38'. This is accomplished by simply grasping the end plate 51 or 51' at the tabs T or T' and pulling the end plate away from the housing. The display card 2 is then inserted into the longitudinal slot 7 and pushed down through the gap G of the left end piece 50 and gap G' of the right end piece 50'. The lower edge of the display card 2 will continue down through the gaps G, G' until it rests on top of the bosses 24 (see FIG. 3).

At this time, the user simply pushes the end pieces 50 and 50' inwardly within the housing 3. During inward movement of the end piece 50, the ledges 71 and 72 slide between the rails R and R' and are pressed together by the webs W so as to pinch the display card 2 in the gap G. At the final position, when the outer surface of end plate 51 is flush with the lower section 30 of the end wall 5, the horizontal wall 66 engages with the notch 80 so as to lock the card in place. The operation of the end piece 50' is identical.

In order to release the display card 2 from the holder 1, the user simply pulls out the two end pieces 50 and 50' by grasping the corresponding end plates 51 and 51'.

The holder may be formed from any suitable material but preferably is formed of a plastic, e.g., polystyrene (PS).

Figure 6:
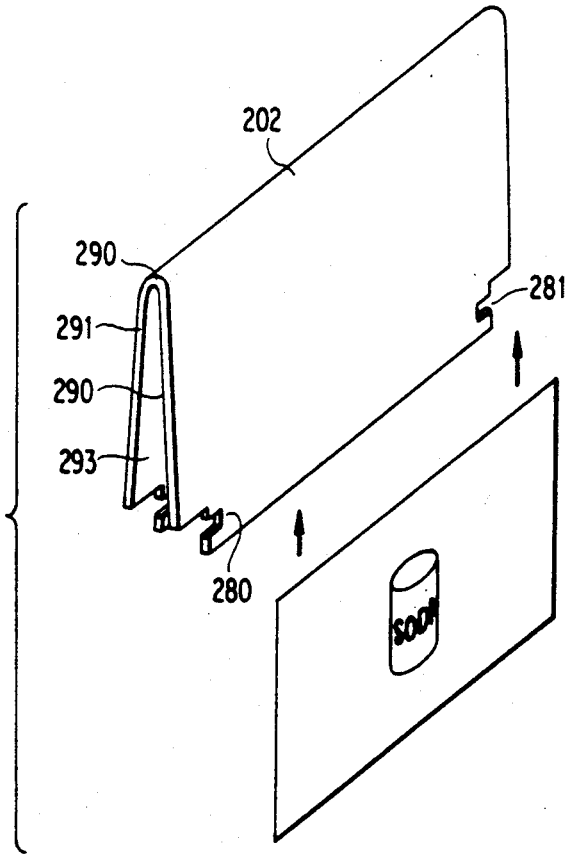
FIG. 6 is a perspective view showing an alternative signage.

Further, while the holder 1 is shown in FIGS. 1 and 2 releasably mounting a display card 2, the card 2 could alternatively be replaced by a transparent member 202 which includes notches 280, 281 near the lower edge as shown in FIG. 6. The transparent member 202 has a U-shaped cross section with a fold on top. The two legs of the U form front and back surfaces 290 and 291 of the transparent member 202, with a small gap 293 formed therebetween for the purpose of inserting a sign, advertisement, etc., 294. The transparent member 202 may be welded along the vertical sides to prevent bowing. The free ends of the U are inserted into the holder 1 and the notches 280 and 281 are engaged by the end pieces 50 and 51' in the same manner as the display card 2. The transparent member 202 may be formed of polycarbonate or a rigid vinyl.

It is contemplated that numerous modifications may be made to the display card holder of the present invention without departing from the spirit and scope of the invention as defined in the following claims.

What is claimed is:

1. A display card holder for releasably mounting a display card, said display card holder comprising:

a) a support means;

b) a substantially hollow, substantially enclosed, elongated housing having a body portion and first and second end walls, said housing being connected to said support means by fastening means, said body portion having a longitudinal slot extending along an upper surface thereof and communicating an interior of said body portion with an exterior of said body portion and for receiving an edge portion of said display card such that a remaining portion of the display card extends freely away from said display card holder, each of said first and second end walls having an opening therethrough;

c) guide means disposed within said housing and positioned proximate to said opening in each of said first and second end walls; and d) first and second end pieces respectively passing through a corresponding said opening in said first and second end walls, said first and second end pieces being slidably supported on said guide means, each of said first and second end pieces comprising a pinching means including a bifurcated member having a gap adapted to receive and pinch the edge portion of said display card.

2. The display card holder according to claim 1, wherein said housing is generally elliptical in shape and has a flat surface on a front portion thereof.

3. The display card holder according to claim 1, wherein each said end piece comprises an end plate having an outer surface and an inner surface, said bifurcated member extending from said inner surface of said end plate and passing through a corresponding said opening and into said housing.

4. The display card holder according to claim 1, wherein each said end piece further comprises a locking member.

5. The display card holder according to claim 4, wherein said bifurcated member comprises first and second vertical walls, said gap being formed between said vertical walls at a lower portion thereof, and wherein said locking member is a horizontal wall extending inwardly from an inner surface of said end plate and connected between said vertical walls at an upper portion thereof, said horizontal wall adapted to engage a corresponding notch in said display card.

6. The display card holder according to claim 1, wherein said support means comprises a stand having a platform and a pair of substantially vertical arms, each of said vertical arms being positioned in a corresponding channel formed in an underside of said housing at each of said first and second end walls.

7. The display card holder according to claim 5, wherein each said end piece further comprises first and second ledges respectively extending perpendicularly from said first and second vertical walls and being slidably supported by said guide means.

8. The display card holder according to claim 7, wherein said guide means comprises upper and lower rails which project from said housing at opposite sides of each of said openings in said first and second end walls.

9. The display card holder according to claim 8, wherein a converging path is formed between said upper and lower rails, such that, when each said end piece is pushed within said housing, said first and second ledges are pressed together and said first and second vertical walls are in turn pressed together to thereby reduce the size of said gap.

10. A sign holder for releasably mounting a sign, said sign holder comprising:

a) a support means;

b) an elongated, substantially enclosed housing having a body portion and first and second end walls, said housing being mounted to said support means, said body portion having a slot communicating an interior of said body portion with an exterior of said body portion and for receiving an edge portion of said sign such that a remaining portion of said sign extends freely away from said sign holder, each of said first and second end walls having an opening therethrough;

c) guide means disposed within said housing and positioned proximate to said opening in each of said first and second end walls; and d) first and second end pieces respectively passing through a corresponding said opening in said first and second end walls, said first and second end pieces being slidably supported on said guide means, each of said first and second end pieces comprising pinching means integral therewith for directly receiving and pinching therein the edge portion of said sign.

11. The sign holder according to claim 10, wherein said pinching means comprises a bifurcated member having a gap adapted to receive and pinch the edge portion of said sign.

12. The sign holder according to claim 11, wherein each end piece comprises an end plate having an outer surface and an inner surface, said bifurcated member extending from said inner surface of said end plate and passing through a corresponding said opening and into said housing.

13. The sign holder according to claim 12, wherein each said end piece further comprises a locking member.

14. A display card holder for releasably mounting a display card, said display card holder comprising:

a) a support means;

b) a substantially hollow, elongated housing having a body portion and first and second end walls, said housing being connected to said support means by fastening means, said body portion having a longitudinal slot extending along an upper surface thereof and for receiving said display card, each of said first and second end walls having an opening;

c) guide means disposed within said housing and positioned proximate to said opening in each of said first and second end walls; and d) first and second end pieces respectively passing through a corresponding said opening in said first and second end walls, said first and second end pieces being slidably supported on said guide means, each of said first and second end pieces comprising a pinching means including a bifurcated member having a gap adapted to receive and pinch an edge of said display card, and further comprising an end plate having an outer surface and an inner surface, said bifurcated member extending from said inner surface of said end plate and passing through a corresponding said opening an into said housing.

15. A display card holder for releasably mounting a display card, said display card holder comprising:

a) a support means;

b) a substantially hollow, elongated housing having a body portion and first and second end walls, said housing being connected to said support means by fastening means, said body portion having a longitudinal slot extending along an upper surface thereof and for receiving said display card, each of said first and second end walls having an opening;

c) guide means disposed within said housing and positioned proximate to said opening in each of said first and second end walls; and d) first and second end pieces respectively passing through a corresponding said opening in said first and second end walls, said first and second end pieces being slidably supported on said guide means, each of said first and second end pieces comprising a pinching means including a bifurcated member having a gap adapted to receive and pinch an edge of said display card, and further comprising a locking member;

wherein said bifurcated member comprises first and second vertical walls, said gap being formed between said vertical walls at a lower portion thereof, and wherein said locking member is a horizontal wall extending inwardly from an inner surface of said end plate and connected between said vertical walls at an upper portion thereof, said horizontal wall adapted to engage a corresponding notch in said display card.

16. A display card holder for releasably mounting a display card, said display card holder comprising:

a) a support means;

b) a substantially hollow, elongated housing having a body portion and first and second end walls, said housing being connected to said support means by fastening means, said body portion having a longitudinal slot extending along an upper surface thereof and for receiving said display card, each of said first and second end walls having an opening;

c) guide means disposed within said housing ad positioned proximate to said opening in each of said first and second end walls; and d) first and second end pieces respectively passing through a corresponding said opening in said first and second end walls, said first and second end pieces being slidably supported on said guide means, each of said first and second end pieces comprising a pinching means including a bifurcated member having a gap adapted to receive and pinch an edge of said display card;

wherein said support means comprises a stand having a platform and a pair of substantially vertical arms, each of said vertical arms being positioned in a corresponding channel formed in an underside of said housing at each of said first and second end walls.

17. The display card holder according to claim 16, wherein said fastening means permits angular adjustment of said housing and said display card with respect to said stand.

18. A sign holder for releasably mounting a sign, said sign holder comprising:

a) a support means;

b) an elongated housing having a body portion and first and second end walls, said housing being mounted to said support means, said body portion having a slot for receiving a portion of said sign, each of said first and second end walls having an opening therein;

c) guide means disposed within said housing and positioned proximate to said opening in each of said first and second end walls; and d) first and second end pieces respectively passing through a corresponding said opening in said first and second end walls, said first and second end pieces being slidably supported on said guide means, each of said first and second end pieces comprising pinching means for pinching said portion of said sign, said pinching means comprising bifurcated member having a gap adapted to receive and pinch said portion of said sign, wherein each end piece further comprises an end plate having an outer surface and an inner surface, said bifurcated member extending from said inner surface of said end plate and passing through a corresponding said opening and into said housing.

19. The sign holder according to claim 18, wherein each said end piece further comprises a locking member.

* * * * *